US005387346A

United States Patent [19]

Hartley et al.

[11] Patent Number: 5,387,346

[45] Date of Patent: Feb. 7, 1995

[54] AUTOMATIC TRANSMISSION FLUIDS AND ADDITIVES THEREFOR

[75] Inventors: Rolfe J. Hartley; Douglas R. Chrisope, both of St. Louis, Mo.

[73] Assignee: Ethyl Petroleum Additives, Inc., Richmond, Va.

[21] Appl. No.: 94,482

[22] Filed: Jul. 19, 1993

Related U.S. Application Data

[63] Continuation of Ser. No. 972,862, Nov. 6, 1992, abandoned, which is a continuation of Ser. No. 512,406, Apr. 23, 1990, abandoned.

[51] Int. Cl.[6] ..... C10M 111/04; C10M 111/02

[52] U.S. Cl. ..... 252/49.9; 252/51.5 A

[58] Field of Search ..... 252/51.5 A, 49.9

[56] References Cited

U.S. PATENT DOCUMENTS

| | | | |
|---|---|---|---|
| 3,131,150 | 4/1964 | Stuart et al. | 252/51.5 A |
| 3,172,892 | 3/1965 | LeSuer et al. | 260/326.5 |
| 3,202,678 | 8/1965 | Stuart et al. | 252/51.5 A |
| 3,361,673 | 1/1968 | Stuart et al. | 252/51.5 A |
| 3,763,244 | 10/1973 | Shubkin | 260/676 R |
| 3,816,346 | 6/1974 | Coppock et al. | 252/32.5 |
| 3,991,056 | 11/1976 | Okamoto et al. | 260/268 C |
| 4,036,771 | 7/1977 | Denis et al. | 252/56 R |
| 4,118,329 | 10/1978 | Hotten | 252/32.5 |
| 4,234,435 | 11/1980 | Meinhardt et al. | 252/51.5 A |
| 4,282,392 | 8/1981 | Cupples et al. | 585/510 |
| 4,299,714 | 11/1981 | Sugiura et al. | 252/73 |
| 4,418,234 | 11/1983 | Schiff et al. | 252/51.5 A |
| 4,428,849 | 1/1984 | Wisotsky | 252/51.5 A |
| 4,587,368 | 5/1986 | Pratt | 585/12 |
| 4,654,403 | 3/1987 | Tipton | 525/194 |
| 4,734,446 | 3/1988 | Tipton | 524/106 |
| 4,747,971 | 5/1988 | Erdman | 252/32.5 |
| 4,758,364 | 7/1988 | Seki et al. | 252/56 R |
| 4,762,628 | 8/1988 | Phillips et al. | 252/51.5 R |
| 4,801,390 | 1/1989 | Robson | 252/51.5 A |
| 4,827,064 | 5/1989 | Wu | 585/10 |
| 4,827,073 | 5/1989 | Wu | 585/530 |
| 4,853,139 | 8/1989 | Ichihashi | 252/51.5 A |
| 4,857,214 | 8/1989 | Papay et al. | 252/51.5 A |
| 4,956,122 | 9/1990 | Watts et al. | 252/565 |
| 4,992,183 | 2/1991 | Beimesch et al. | 252/32.7 E |
| 5,089,156 | 2/1992 | Chrisope et al. | 252/49.9 |

FOREIGN PATENT DOCUMENTS

| | | |
|---|---|---|
| 0240813 | 10/1987 | European Pat. Off. . |
| 0305538 | 3/1989 | European Pat. Off. . |
| 0452998 | 10/1991 | European Pat. Off. . |
| 0454395 | 10/1991 | European Pat. Off. . |
| 0479353 | 4/1992 | European Pat. Off. . |
| 0716247 | 10/1966 | Italy . |
| 961009 | 6/1964 | United Kingdom . |
| 2057494 | 4/1981 | United Kingdom . |
| 2094339 | 9/1982 | United Kingdom . |

OTHER PUBLICATIONS

SAE Technical Paper 8211181, copyright 1982.

Collection of documents believed to have been received from Uniroyal at least by May, 1980.

"Synton", an undated brochure from Uniroyal.

Internal memorandum dated Apr. 29, 1980.

ASLE Transactions, vol. 9, No. 1, pp. 1–12, 1966 (month unknown).

NLGI Spokesman, Aug. 1980, pp. 168–175.

Campen et al., "Growing Use of Synlubes", Hydrocarbon Processing, Feb. 1982, pp. 75–81.

*Primary Examiner*—Jerry D. Johnson

[57] ABSTRACT

A lubricant composition especially adapted for use as an automatic transmission fluid, which composition consists essentially of: a) from 50 to 85 weight percent of a mineral oil having a viscosity at 100° C. in the range of 3 to 5 centistokes; b) from 5 to 35 weight percent of a poly-α-olefin lubricating oil having a viscosity at 100° C. in the range of 1 to 8 centistokes; and c) from 8 to 15 weight percent of a combination of alkenyl succinimide dispersant, viscosity index improver and antioxidant; said composition being further characterized in that it contains less than 7.0 weight percent of viscosity index improver and in that the composition has a Brookfield viscosity at −40° C. of no more than 20,000 cP.

20 Claims, No Drawings

AUTOMATIC TRANSMISSION FLUIDS AND ADDITIVES THEREFOR

This is a continuation of copending application Ser. No. 07/972,862 filed on Nov. 6, 1992 now abandoned, which is a continuation of Ser. No. 07/512,406, filed Apr. 23, 1990 now abandoned.

At least one original equipment manufacturer desires to lower the −40° C. Brookfield viscosity-requirement (ATF) from the current maximum of 50,000 cP to 20,000 cP. While this target can be accomplished by addition of light mineral base oils to conventional base oils used in formulating ATF, it is necessary to add significant additional quantities of VI improver to boost high temperature viscosity and to combat the resultant poorer shear stability of the fluid. The addition of extra VI improver is of concern with respect to potential wear, oxidation and shear problems. Moreover not all manufacturers of ATF have available to them the light mineral base oils needed to achieve such low temperature properties.

This invention involves the discovery that it is possible to avoid the foregoing problems by utilizing certain combinations of components, hereinafter described in conjunction with mineral lubricating oils such as are used in the formulation of ATF compositions.

More particularly, it has been found possible to produce ATF compositions having Brookfield viscosities of 20,000 cP or less without need for excessive quantities of VI Improvers.

Pursuant to this invention there is provided, in one of its embodiments, a lubricant composition especially adapted for use as an automatic transmission fluid, which composition consists essentially of: a) from 50 to 85 weight percent of a mineral oil having a viscosity at 100° C. in the range of 3.0 to 5.0 centistokes; b) from 5 to 35 weight percent of a poly-α-olefin lubricating oil having a viscosity at 100° C. in the range of 1 to 8 centistokes; and c) from 8 to 15 weight percent of a combination of alkenyl succinimide dispersant, viscosity index improver and antioxidant; said composition being further characterized in that it contains less than 7.0 weight percent of viscosity index improver and in that the composition has a Brookfield viscosity at −40° C. of no more than 20,000 cP. Preferably the mineral oil of such formulations corresponds, or is blended to correspond to a 100 solvent neutral mineral oil. However, mineral oils having viscosity characteristics comparable to or in the general vicinity of 100 solvent neutral mineral oil can be employed.

Another embodiment of this invention involves the provision of an additive concentrate especially adapted for use in forming an automatic transmission fluid when blended with 100 solvent neutral mineral oil, which concentrate comprises: a) poly-α-olefin lubricating oil having a viscosity at 100° C. in the range of 1 to 5 centistokes; and b) a combination of alkenyl succinimide dispersant, viscosity index improver and antioxidant; said concentrate being further characterized in that it contains less than 7.0 weight percent of viscosity index improver and in that if blended with 100 solvent neutral mineral oil at a concentration of 20 to 30 weight percent it forms a composition having a Brookfield viscosity at −40° C. of no more than 20,000 cP.

Preferably the poly-α-olefin lubricating oil used in the compositions of this invention has a viscosity at 100° C. of about 2 to 4 centistokes.

Various alkenyl succinimide dispersants can be used in the compositions of this invention. These include acyclic hydrocarbyl substituted succinimides formed with various āmines or amine derivatives such as are widely disclosed in the patent literature. See for example U.S. Pat. No. 4,234,435, the disclosure of which concerning alkenyl succinimides is incorporated herein by reference. Use of alkenyl succinimides which have been treated with an inorganic acid of phosphorus (or an anhydride thereof) and a boronating agent are preferred for use in the compositions of this invention as they are much more compatible with elastomeric seals made from such substances as fluoro-elastomers and silicon-containing elastomers. See in this connection, U.S. Pat. No. 4,857,214, the disclosure of which is incorporated herein with respect to the formation of such specially treated succinimide dispersants. Polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 500 to 5000 (preferably 800 to 2500) are particularly suitable, especially when treated with phosphorus and boron compounds as described in U.S. Pat. No. 4,857,214. The finished ATF composition will usually contain from about 1.5 to about 4.0 percent by weight of such dispersants.

Viscosity index improvers which may be included in the compositions of this invention include such materials as polymethacrylate polymers, polyacrylate polymers, styrene-maleic ester copolymers, and similar polymeric substances including homopolymers, copolymers, and graft copolymers. As noted above, the finished ATF composition will normally contain less than 7.0 weight percent of viscosity index improver.

Antioxidants or stabilizers useful in the compositions of this invention include phenyl alpha naphthylamine, phenyl beta naphthylamine, diphenylamine, bis-alkylated diphenyl amines (e.g., p,p'-bis(alkylphenyl)amines wherein the alkyl groups contain from 8 to 12 carbon atoms each), sterically hindered phenols (e.g., 2,6-di-tert-butylphenol, 4-methyl-2,6-di-tert-butylphenol, etc.) and bis-phenols (e.g., 4,4'-methylenebis(2,6-di-tert-butylphenol), etc.) and the like. Amounts in the range of 0.1 to 0.7 weight percent in the finished ATF composition are typical.

The additive concentrates of this invention will contain the dispersant, viscosity index improver, antioxidant, and poly-α-olefin oil in relative proportions such that an adding the concentrate at a concentration of from 12.0 to 45.0 weight percent to a suitable mineral oil, the resultant fluid will contain each of the ingredients in the desired concentration. It is of course possible, though less desirable, to blend the components separately or in subcombinations with the mineral oil.

What is claimed is:

1. A lubricant composition especially adapted for use as an automatic transmission fluid, which composition consists essentially of:

a) from 50 to 85 weight percent of a mineral oil having a viscosity at 100° C. in the range of 3 to 5 centistokes;

b) from 5 to 35 weight percent of a poly-α-olefin lubricating oil having a viscosity at 100° C. in the range of 1 to 8 centistokes; and c) from 8 to 15 weight percent of a combination of alkenyl succinimide dispersant, viscosity index improver and antioxidant;

said composition being further characterized in that it contains less than 7.0 weight percent of viscosity index improver and in that the composition has a Brookfield viscosity at −40° C. of no more than 20,000 cP.

2. A composition as claimed in claim 1 wherein the mineral lubricating oil is a 100 solvent neutral mineral oil.

3. A composition as claimed in claim 2 wherein the poly-α-olefin lubricating oil has a viscosity at 100° C. of about 2 to 4 centistokes.

4. A composition as claimed in claim 1 wherein the alkenyl succinimide dispersant is an alkenyl succinimide that has been treated with an inorganic acid of phosphorus or an anhydride thereof and a boronating agent.

5. A composition as claimed in claim 4 wherein said alkenyl succinimide is a polyisobutenyl succinimide of polyalkylene polyamine.

6. A composition as claimed in claim 5 wherein said polyalkylene polyamine consists essentially of tetraethylene pentamine.

7. A composition as claimed in claim 5 wherein said polyisobutenyl succinimide is derived from polyisobutene having a number average molecular weight in the range of 500 to 5000.

8. A composition as claimed in claim 5 wherein said polyisobutenyl succinimide is derived from polyisobutene having a number average molecular weight in the range of 800 to 2500.

9. A method of forming an automatic transmission fluid which comprises blending 12 to 45 weight percent of an additive concentrate especially adapted for use in forming an automatic transmission fluid with mineral oil having a viscosity at 100° C. in the range of 3 to 5 centistokes, which concentrate comprises: a) poly-α-olefin lubricating oil having a viscosity at 100° C. in the range of 1 to 8 centistokes; and b) a combination of alkenyl succinimide dispersant, viscosity index improver, and antioxidant; said concentrate being further characterized in that when blended with said mineral oil it forms a finished ATF composition (i) containing less than 7.0 weight percent of viscosity index improver and (ii) having a Brookfield viscosity at −40° C. of no more than 20,000 cP.

10. A composition as claimed in claim 9 wherein the poly-α-olefin lubricating oil has a viscosity at 100° C. of about 2 to 4 centistokes.

11. A composition as claimed in claim 9 wherein the alkenyl succinimide dispersant is an alkenyl succinimide that has been treated with an inorganic acid of phosphorus or an anhydride thereof and a boronating agent.

12. A composition as claimed in claim 11 wherein said alkenyl succinimide is a polyisobutenyl succinimide of polyalkylene polyamine.

13. A method as claimed in claim 12 wherein said polyalkylene polyamine consists essentially of tetraethylene pentamine.

14. A method of forming an automatic transmission fluid which comprises blending 20 to 30 weight percent of an additive concentrate especially adapted for use in forming an automatic transmission fluid with 100 solvent neutral mineral oil, which concentrate comprises: a) poly-α-olefin lubricating oil having a viscosity at 100° C. in the range of 1 to 8 centistokes; and b) a combination of alkenyl succinimide dispersant, viscosity index improver, and antioxidant; said concentrate being further characterized in that when blended with said mineral oil it forms a finished ATF composition (i) containing less than 7.0 weight percent of viscosity index improver and (ii) having a Brookfield viscosity at −40° C. of no more than 20,000 cP.

15. A method as claimed in claim 14 wherein the poly-α-olefin lubricating oil has a viscosity at 100° C. of about 2 to 4 centistokes.

16. A method as claimed in claim 14 wherein the alkenyl succinimide dispersant is an alkenyl succinimide that has been treated with an inorganic acid of phosphorus or an anhydride thereof and a boronating agent.

17. A method as claimed in claim 16 wherein said alkenyl succinimide is a polyisobutenyl succinimide of polyalkylene polyamine.

18. A method as claimed in claim 16 wherein said polyalkylene polyamine consists essentially of tetraethylene pentamine.

19. A method as claimed in claim 17 wherein said polyisobutenyl succinimide is derived from polyisobutene having a number average molecular weight in the range of 500 to 5000.

20. A method as claimed in claim 17 wherein said polyisobutenyl succinimide is derived from polyisobutene having a number average molecular weight in the range of 800 to 2500.

* * * * *